US005501270A

United States Patent [19]

Young et al.

[11] Patent Number: 5,501,270

[45] Date of Patent: Mar. 26, 1996

[54] PLATE FIN HEAT EXCHANGER

[75] Inventors: Darryl L. Young, Belleville; Barry W. Blumel, Livonia, both of Mich.

[73] Assignee: Ford Motor Company, Dearborn, Mich.

[21] Appl. No.: 401,579

[22] Filed: Mar. 9, 1995

[51] Int. Cl.[6] ..... F28F 1/32

[52] U.S. Cl. ..... 165/151; 165/182; 165/DIG. 503

[58] Field of Search ..... 165/151, 182

[56] References Cited

U.S. PATENT DOCUMENTS

| | | |
|---|---|---|
| 3,182,481 | 5/1965 | Oddy et al. . |
| 3,190,353 | 6/1965 | Storfer . |
| 3,829,647 | 8/1974 | Cleaveland . |
| 4,300,629 | 11/1981 | Hatada et al. . |
| 4,428,419 | 1/1984 | Dubrovsky et al. . |
| 4,586,563 | 5/1986 | Dubrovsky et al. . |
| 4,705,105 | 11/1987 | Cur . |
| 4,791,984 | 12/1988 | Hatada et al. . |
| 5,062,475 | 11/1991 | Bemisderfer et al. . |
| 5,353,866 | 10/1994 | Ueda et al. . |

FOREIGN PATENT DOCUMENTS

| | | | |
|---|---|---|---|
| 2398279 | 3/1979 | France | 165/151 |
| 929521 | 6/1955 | Germany . | |
| 55-134294A | 10/1980 | Japan . | |
| 61-159095 | 7/1986 | Japan | 165/151 |
| 61-211697A | 9/1986 | Japan . | |
| 2-275295 | 11/1990 | Japan | 165/151 |
| 964422 | 10/1982 | U.S.S.R. . | |
| 23227 | 10/1904 | United Kingdom . | |
| 509109 | 7/1939 | United Kingdom | 165/151 |
| 784924 | 10/1957 | United Kingdom | 165/151 |
| 2027533 | 2/1980 | United Kingdom | 165/151 |
| 2110811 | 6/1983 | United Kingdom . | |

*Primary Examiner*—Allen J. Flanigan

*Attorney, Agent, or Firm*—Raymond L. Coppiellie; Roger L. May

[57] ABSTRACT

A fin for use in a heat exchanger of the type comprising a plurality of fluid carrying tubes for transporting heat exchange fluid is disclosed. The fin includes a generally planar base 24 having a longitudinal axis generally perpendicular to the direction of air flowing entering the heat exchanger 10 and a transverse axis generally parallel to the direction of air flow. The axes define a main plane disposed at a predetermined angle (θ) relative to the direction of air flow entering the heat exchanger. The fin 22 further includes a plurality of apertures 30 for receiving tubes 20 therethrough and a plurality of louvres 32 disposed on the base 24 extending generally parallel to the longitudinal axis of the base. The angle θ can be between 140 and 175 degrees to the direction of air flow entering the heat exchanger.

14 Claims, 5 Drawing Sheets

FIG.8
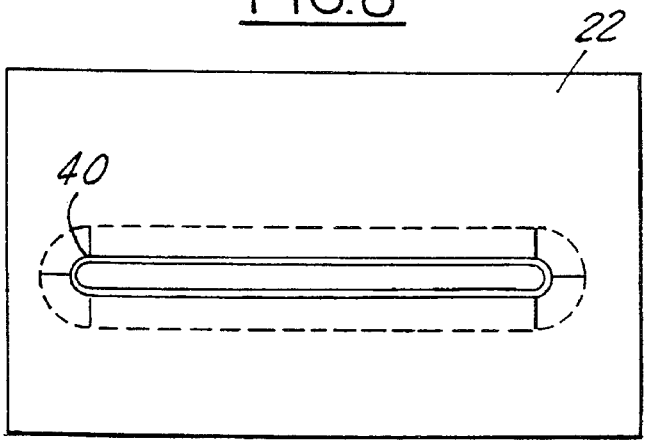
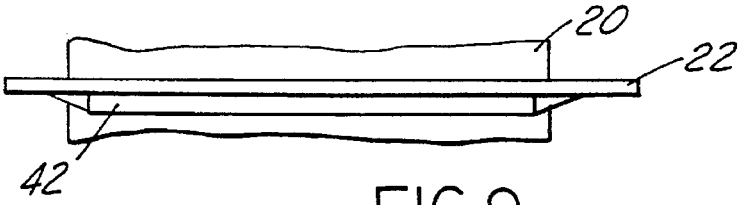
FIG.9
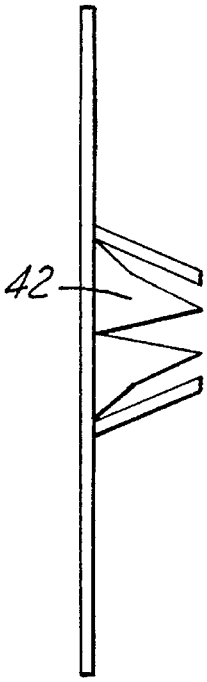
FIG.10
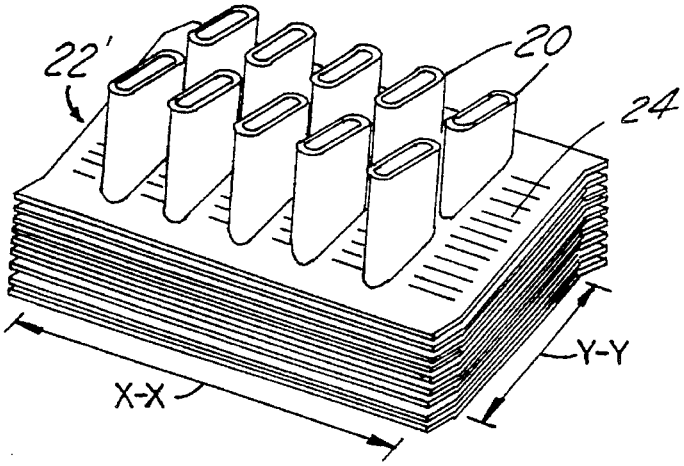
FIG.11
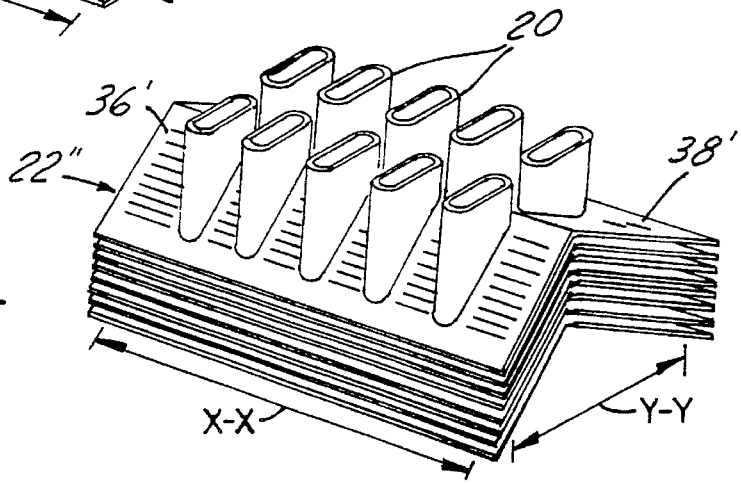
FIG.12

PLATE FIN HEAT EXCHANGER

BACKGROUND OF THE INVENTION

1. Field of the Invention

The present invention relates generally to a plate fin type heat exchanger. More particularly, the present invention relates to a plate fin heat exchanger wherein the plate fins are disposed at an angle relative to the direction of air flowing through the heat exchanger.

2. Disclosure Information

A typical plate fin and tube type heat exchanger consists of a heat exchanger core having multiple tubes, or multiple rows of tubes, conveying a first heat exchange medium such as a refrigerant or coolant, with the tubes normally being perpendicular to the flow of a second heat exchange medium, such as air. The rows of tubes pass through multiple substantially parallel fins which are formed of thin plates of heat conducting material such as aluminum. The plates generally lie in planes substantially parallel to the airflow entering the front face of the heat exchanger. The fin plates may be flat or include some convolution portions slightly inclined to the direction of air flow.

As is well known in the heat exchanger art, the first heat exchange fluid flowing inside the tubes is used to heat or cool a second heat exchange fluid passing over fins external of the tubes. In the type of heat exchanger contemplated herein, the second heat exchange fluid is a gaseous medium and is normally air, so that the term "air side" is used herein to refer to the heat exchange between the fins and the second heat exchange fluid passing there over. The term "air" is intended to include both atmospheric air and other gaseous fluids acting as the second heat exchange medium. For a fin and tube heat exchanger, the overall heat transfer is largely controlled by the air side heat transfer coefficient and amount of effective air side heat transfer area. The air side heat transfer coefficient is largely controlled by the boundary layer growth along the fin.

As is further well known in the art, it has long been known to increase the air flow turbulence across the fin and reduce the boundary layer effect by striking louvres from the fin plates. Such louvres are taught in U.S. Pat. No. 5,062,475 wherein the louvres are chevron-shaped with one leg of the louvres lying in the plane of a fin convolution. The '475 patent teaches a plate fin wherein the louvres formed in localized corrugations have different leg lengths to provide increased air turbulence and reduced boundary layer effects. In such a design, the corrugation is localized and the height of the corrugation is limited by the thickness of the fin plate. Inasmuch as it is desirable to minimize the overall thickness of the fin plate, the overall height of the corrugation is somewhat limited.

Referring now to FIG. 1, a cross-sectional view of a typical chevron-shaped louvre corrugation is shown. As can be seen, the air flow through the louvres (indicated by A) can be somewhat tortuous resulting in an increase pressure buildup along the air side of the heat exchanger and ultimately a large pressure drop on the exit side of the heat exchanger. It would, therefore, be desirable to provide a plate fin design which allows the air entering the heat exchanger to strike a plurality of louvre front edges without turning or turbulating the air as it passes through the heat exchanger, resulting in decreased boundary layer effects and higher efficiency of the heat exchanger.

Therefore, it would be advantageous to provide a plate fin heat exchanger which reduces the pressure drop across the heat exchanger and improve its overall heat exchange effectiveness.

SUMMARY OF THE INVENTION

The present invention solves the problems associated with the prior art by providing a fin for use in a heat exchanger of the type comprising a plurality of fluid carrying tubes for transporting a heat exchange fluid therein, the plurality of tubes extending longitudinally from one fluid manifold and being disposed between a pair of endsheets. Each of the tubes defines a longitudinal axis parallel to the flow of fluid through the tube. The fin comprises a generally planar base having a base longitudinal axis extending between the pair of endsheets, the base longitudinal axis being generally perpendicular to the tube longitudinal axis. The fin base also defines a transverse axis generally perpendicular to the base longitudinal axis but being canted at a predetermined angle relative to the tube longitudinal axis, the base longitudinal and transverse axes defining a main plane wherein substantially the entire main plane of said base is disposed at the predetermined angle relative to the tube longitudinal axis. The fin also includes a plurality of apertures for receiving the tubes therethrough and a plurality of louvres disposed on the base and extending generally parallel to the longitudinal axis of the base.

It is an advantage of the present invention to provide a fin which reduces the pressure drop across a heat exchanger. These and other objects, features and advantages of the present invention will become apparent from the drawings, detailed description and claims which follow.

BRIEF DESCRIPTION OF THE DRAWINGS

FIG. 8 is a plan view of an alternative embodiment fin plate structured in accord with the principles of the present invention.

FIG. 9 is a cross-sectional view through line 9—9 of FIG. 8.

FIG. 10 is a side elevational of FIG. 8.

FIG. 11 is a perspective view of an alternative embodiment of a fin of the present invention.

FIG. 12 is a perspective view of an additional alternative embodiment of a fin of the present invention.

DETAILED DESCRIPTION OF THE PREFERRED EMBODIMENTS

Figure 2:
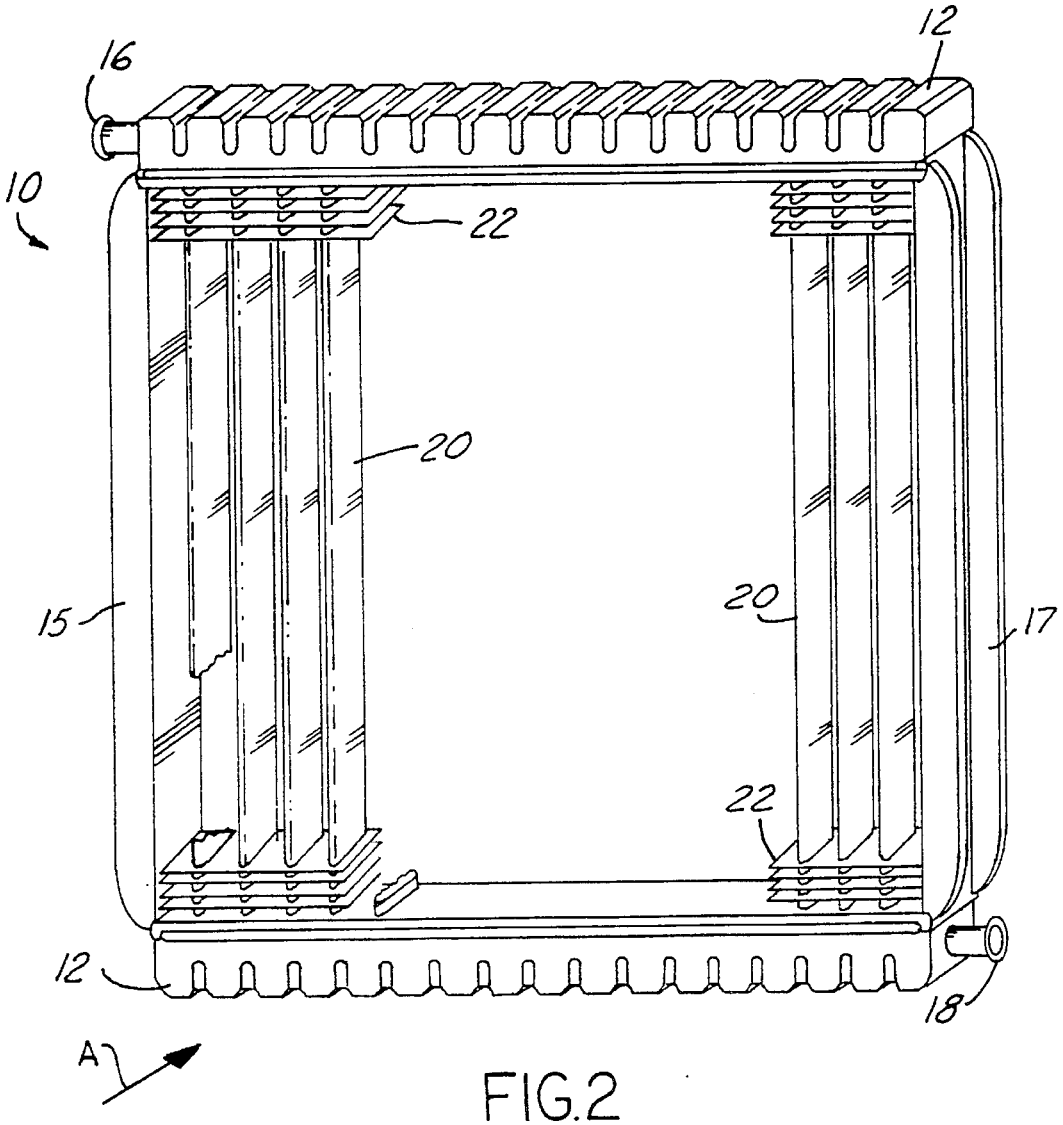
FIG. 2 is perspective view of a heat exchanger structured in accord with the principles of the present invention.
Figure 3:
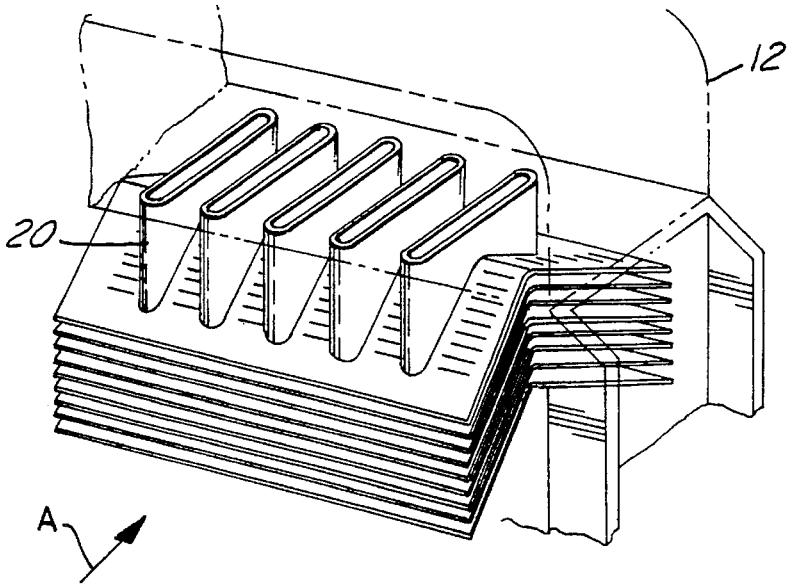
FIG. 3 is a partial perspective view of an alternative embodiment heat exchanger structured in accord with the principles of the present invention.

Referring now to the drawings, FIGS. 2 and 3 show a heat exchanger or heat exchanger core 10 incorporating the concept of the present invention. The heat exchanger 10 as described herein has particular utility as a radiator for an automotive vehicle. However, the concepts described herein as the presently preferred invention may be utilized in other types of heat exchangers such as evaporators, condensers, heater cores, intercores and oil coolers for automotive as well as industrial uses. The heat exchanger 10 includes a pair of fluid tanks 12, 14 disposed at opposite ends as well as a pair of endsheets, 15, 17 disposed at the outboard ends of the tanks. One of the tanks 12 includes a fluid inlet 16 while the other tank includes a fluid outlet 18 through which a heat transfer medium enters and exits the heat exchanger in a known manner. It should be apparent to those skilled in the art that a heat exchanger employing a single tank or having the fluid inlet and outlet on the same tank are well within the scope of the present invention. In a conventional manner, a plurality of heat exchange tubes 20 pass longitudinally through the heat exchanger 10 through a plurality of stacked fin plates 22. As shown in the presently preferred embodiment, the tubes 20 are welded flat tubes each defining a longitudinal axis as noted by letter Z, and having an aspect ratio of 12:1, with the aspect ratio being defined as the ratio of the major axis of the tube to the minor axis of the tube as is well known in the art. It should be further apparent to those skilled in the art that flat tubes having an aspect ratio of greater than 4:1 or round tubes can be utilized in a heat exchanger structured in accord with the principles of the present invention. If an extruded tube is used, the tube can include a plurality of generally parallel flow paths formed therein. Likewise, a turbulating insert may be brazed to the interior of the welded flat tube as is well known in the art to also create a plurality of generally parallel flow paths through the tube 20. A welded flat tube has particular utility in the present invention.

As is known in the art, a heat transfer medium, such as a refrigerant or hot or cold fluid, enters the inlet 16, passes through the tubes 20 and exits the outlet 18. A second heat transfer medium, such as air, indicated by arrow A, impinges the front face or air side of the heat exchanger, passes transversely through the heat exchanger stack and flows over fin plates 22 and tubes 20. The fins 22 act as a secondary heat transfer surface for the tubes 20 and provide the air side heat transfer between the fins and the second heat transfer medium. In the presently preferred embodiment, each fin plate is formed of aluminum sheet and evenly spaced at 10 to 30 fins per linear inch of a heat exchanger stack by means of a fin spacer such as shown at 23.

Figure 4:
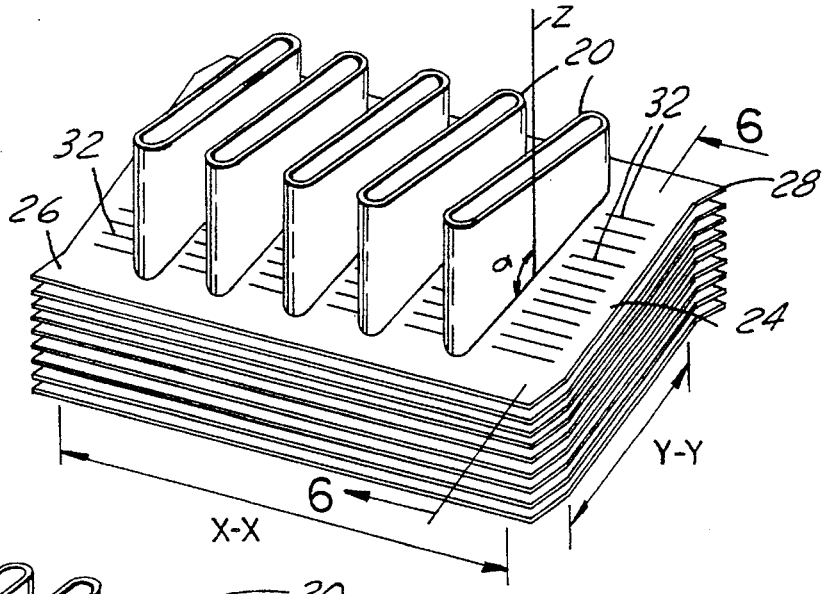
FIG. 4 is an enlarged view of a portion of the heat exchanger of FIG. 2.
Figure 5:
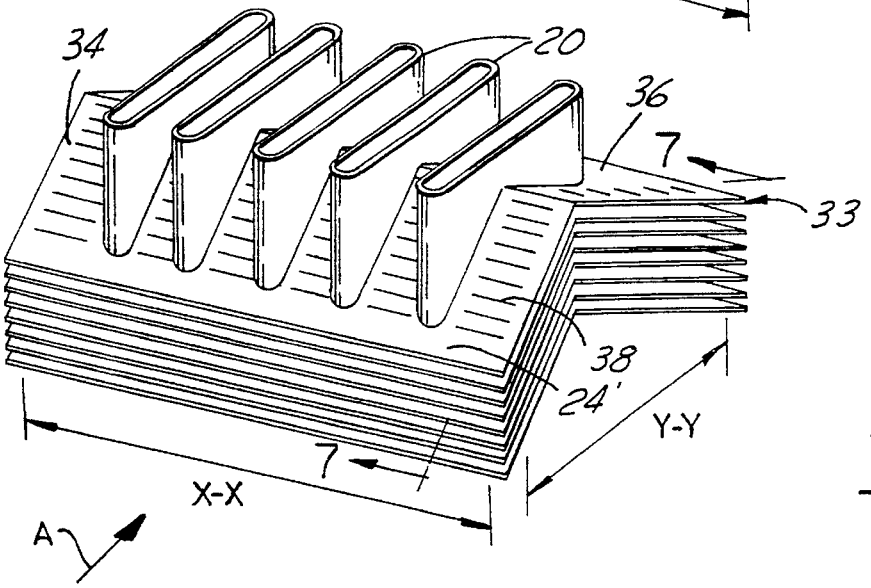
FIG. 5 is an enlarged view of a portion of the heat exchanger of FIG. 3.

As shown more clearly in FIGS. 4 and 5, the fin plates 22 have a longitudinal axis denoted by line X—X and a transverse axis noted by line Y—Y. These axes define a generally planar base 24 which defines a plane disposed at an angle to the direction of air flow A entering the heat exchanger 10. As shown in the FIG. 4 embodiment, the base 24 extends from a first plate edge 26 to a second plate edge 28 along substantially the entire major axis of the tubes 20. The base 24 in FIG. 4 is disposed at an angle $\theta$ of between 140 and 175 degrees to the direction of air flow, A. In the presently preferred embodiment, an angle $\theta$ of 170 degrees provides the most efficient thermal transfer characteristics of the heat exchanger.

An alternative way of expressing the angular relationship of the base 24 is with respect to the longitudinal axis of the tubes, Z in FIG. 4. In this respect, the transverse axis Y—Y of the base 24 is canted at an angle $\alpha$ of between 95 and 130 degrees relative to the longitudinal axis Z of the tubes, with a preferred angle of 100 degrees. The relationship between expressing the canting of the base 24 relative to the direction of air entering the heat exchanger and relative to the longitudinal axis of the tube can be stated in a mathematical relationship: $\alpha=270-\theta$.

Each of the bases 24 of the fin plates 22 includes a plurality of generally raised louvres 32 disposed generally parallel to the longitudinal axis (X—X) of the base 24. As stated above, the louvres 32 increase the turbulence of air flowing through the heat exchanger core and into the heat exchanger plates to prevent the boundary layer buildup along the fins 22. As will be described in more detail below with reference to FIG. 6, each of the louvres 32 is disposed on the base 24 at a predetermined angle, $\phi$ of between 0 and 20 degrees relative to the direction of air flow, A, entering the front face of the heat exchanger. This angular relationship can also be expressed relative to the longitudinal axis of the tubes by the formula: $\beta=90-\phi$, where $\beta$ is the angle (shown in FIG. 6) between the louvre and the longitudinal axis of the tube.

Similarly, FIG. 5 shows a plurality of corrugated fin plates 33 having a base 24' comprising a first portion 34 and a second portion 36. The first portion extends from one plate edge 26 to approximately the center of the major axis of the tube 20 while the second portion 36 extends from the center of the major axis of the tube to the second plate edge 28. Each of these first and second portions are disposed at an angle $\theta$ again of between 140 and 175 degrees to the direction of air flow, A, entering the heat exchanger (5 to 40 degrees for the second portion 36). Each of the first and second portions 34, 36, respectively, includes a plurality of louvres 38 similar to those described above for FIG. 4 wherein each of the louvres is disposed at an angle of approximately 0 to 20 degrees relative to the direction of air flow, A, into the heat exchanger. In the presently preferred embodiment, for the embodiment shown in both FIGS. 4 and 5, the louvre is disposed at a preferred angle of 10 degrees.

Figure 1:
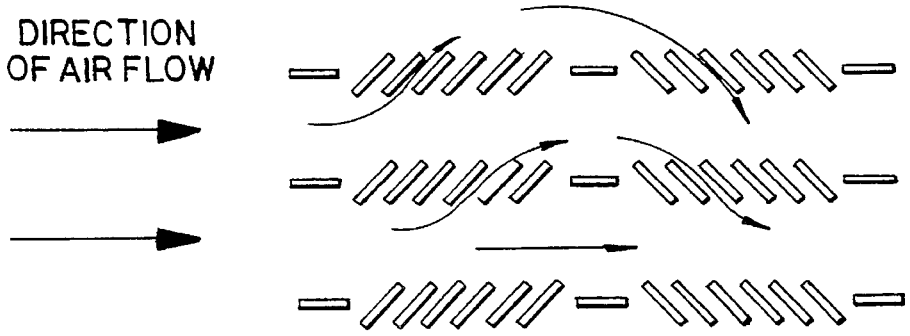
(PRIOR ART) FIG. 1
FIG. 1 is a cross-sectional view of a plurality of louvres disposed on a conventional plate fin for a heat exchanger.
Figure 6:
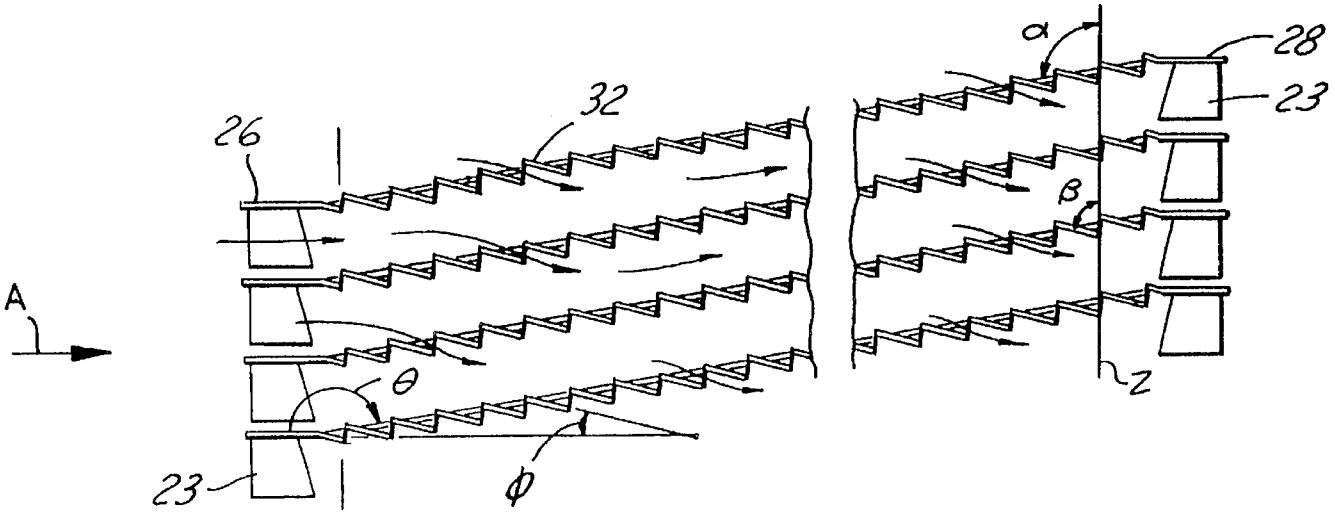
FIG. 6 is a cross-sectional view through lines 6—6 of FIG. 4.
Figure 7:
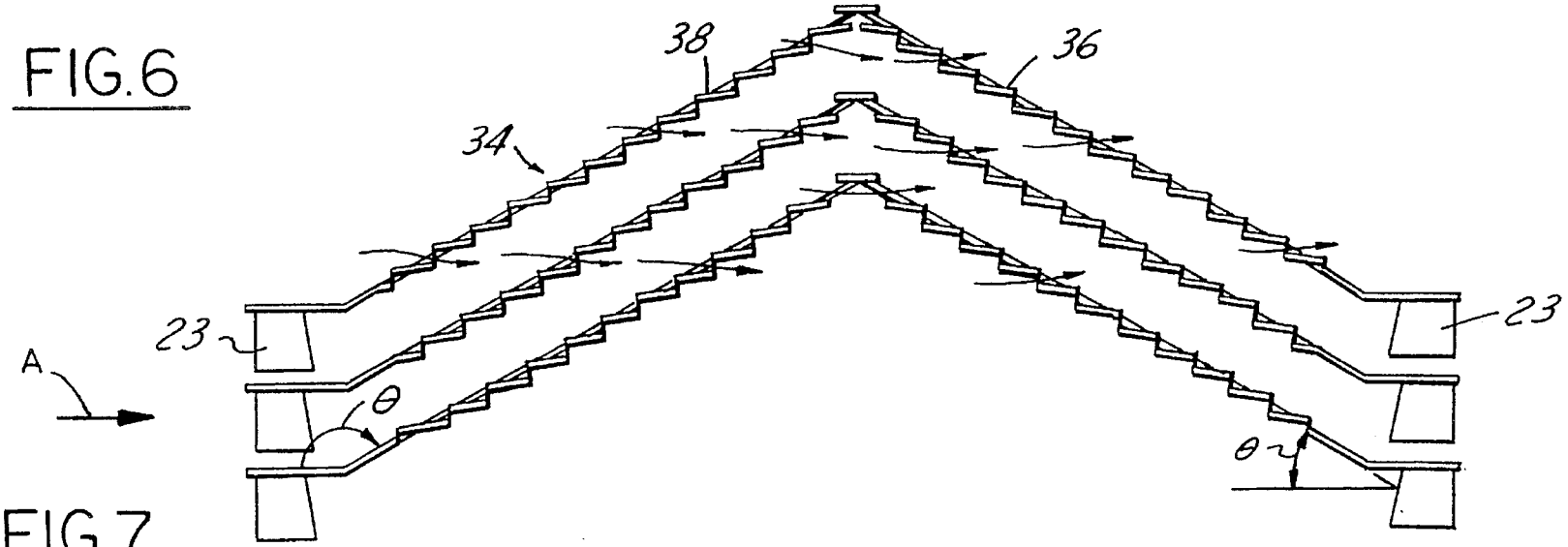
FIG. 7 is a cross-sectional view through lines 7—7 of FIG. 5.

FIGS. 6 and 7 illustrate the advantages and benefits achieved utilizing a fin type structure in accord with the present invention wherein the louvres are angled at approximately 10 degrees and the base being angled at approximately a 170 degree angle relative to the direction of air flowing into the heat exchanger (or 80 degrees (louvres 32) and 100 degrees (base 24) relative to the longitudinal axis of the tubes, Z). FIGS. 6 and 7 show a cross-sectional view through the louvres of each of the embodiments described above in FIGS. 4 and 5. As shown therein, the air flow path is not nearly as tortious as that shown for a typical prior art embodiment shown in FIG. 1. The air flow passes between each of the louvres very easily, increasing the number of louvres contacted by the air stream and thereby increasing the overall effectiveness of the heat exchanger while decreasing the pressure buildup across the heat exchanger. In this manner, a more effective heat exchanger can be manufactured more easily than with the prior art thin plates described previously. Furthermore, manufacturing a fin plate according to the present invention is much less complex than that described or known with prior art fin plates. To manufacture the fin plates shown in FIGS. 4 and 5 the louvres are stamped into each of the plates and then the fin plates are simply corrugated or angled to achieve the desired angle relative no the direction of air flow as described above. By utilizing such a method, straight louvres can be utilized instead of the more common "the V-shaped louvres" decreasing the manufacturing complexity of the fin plate.

FIGS. 11 and 12 show further alternative embodiments of the present invention. FIG. 11 shows a portion of a heat exchanger core utilizing a fin plate 22' similar to that shown in FIG. 4 but structured to accommodate two tubes per fin. As shown in FIG. 11, the base 24' of the fin plate 22' is angled between 140 and 175 degrees to the direction of airflow entering the core as described above. FIG. 12 shows an embodiment similar to FIG. 5. The fin plate 22" of FIG. 12 includes a pair of first portions 36' and a pair of second portions 38' to accommodate a pair of tubes 20. The plate 22" is structured as described above with reference to FIG. 5 and a complete description would be redundant and is unnecessary. However, the fin plate of the present invention can be structured to include a plurality of tubes as well.

FIGS. 8, 9 and 10 show an alternative embodiment which may be added to the fin plate of the present invention. In order to provide for a good metallurgical bonding of the tubes 20 to the fin plate 22, a collar 40 may be formed at each of the tube apertures 30 of the fin plates 22. The collars 40 include a generally perpendicular wall 42 projecting from the plane of the fin plate 22 which surrounds and contacts the tubes 20 as the tubes are inserted through the fin plate. The collar further includes a tooth-shaped corner 42 which is fabricated during the lance or pierce forming of the collar 40. By providing the tubes 20 with a coating of brazing or soldering flux, a good metallurgical bond between the fin plate 22 and the tube can be formed. Furthermore, lacing of the tubes through the fin plates is easier than with prior art designs. Also, the collar 40 provides fin spacing between each fin plate. It is desirable to provide a flat tube which creates more contact between the tube and the fin plate to ensure better heat exchange efficiency than with a tube that needs to be expanded to create a mechanical bond between the tube and the fin plate.

Figure 13:
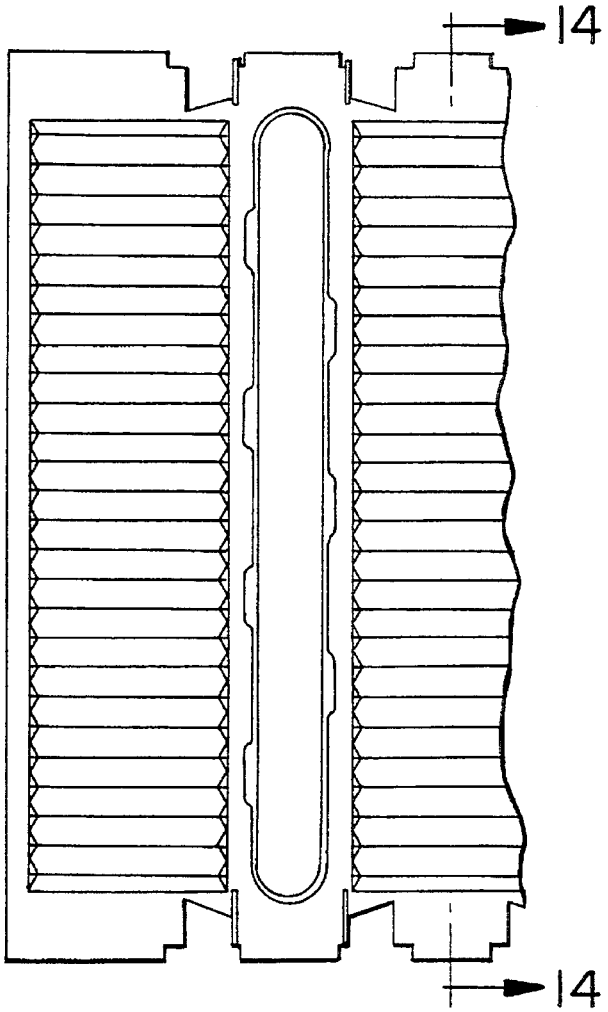
FIG. 13 is a plan view of an alternative embodiment fin plate structured in accord with the principles of the present invention.
Figure 14:
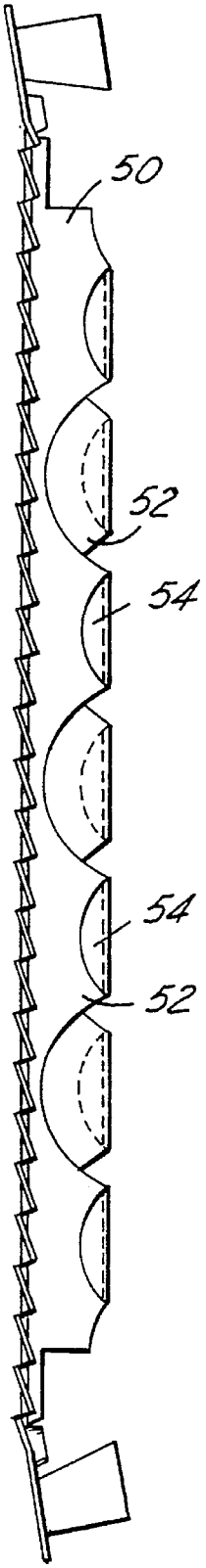
FIG. 14 is a side elevational of FIG. 13.

FIGS. 13 and 14 show alternative collar designs. In this embodiment, the collar 50 includes a plurality of arcuate portions 52, each having a bent-over end 54. The arcuate portions 52 project perpendicularly from the plane of the fin plate and contact the tube as the tube is inserted through the fin plate to provide a metallurgical bond between the tube and fin plate as described above. The arcuate portions also proved spacing between adjacent fin plates. The bent-over ends 54 provide a flat surface to insure a stable contact between fin plates and adequate joining of fin plates to adjacent others.

Other variations and modifications of the present invention will, no doubt, occur to those skilled in the art. The choice of angle measurement may be taken from any reference point; the present invention has been described with reference to the direction of air entering the front face of the heat exchanger. Obviously, the angle θ could be measured as between 5 and 40 degrees (180 degrees opposite that described above). The present invention has applicability to many different types of heat exchangers used in industrial and automotive capacities. It is the following claim, including all equivalents, which define the scope of the invention.

What is claimed is:

1. A fin assembly for use in a heat exchanger, the fin assembly comprising:

at least one tube for transporting a heat exchange fluid therein, the at least one tube extending longitudinally from a fluid manifold and being disposed between a pair of endsheets, the at least one tube defining a longitudinal axis parallel to the flow of fluid therethrough;

a generally planar base having a base longitudinal axis extending between the pair of endsheets, the base longitudinal axis being generally perpendicular to the tube longitudinal axis and a transverse axis generally perpendicular to the base longitudinal axis but being canted at an obtuse angle relative to the tube longitudinal axis, said base longitudinal and transverse axes defining a main plane, and wherein substantially the entire main plane of said base is disposed at said obtuse angle relative to the tube longitudinal axis;

a plurality of apertures for receiving the tubes therethrough; and a plurality of louvres disposed on said base and extending generally parallel to the longitudinal axis of said base.

2. A fin according to claim 1, wherein said main plane of said base is disposed at an angle of between 95 and 130 degrees relative to the tube longitudinal axis.

3. A fin according to claim 1, wherein said main plane of said base is disposed at an angle of 100 degrees relative to the tube longitudinal axis.

4. A fin according to claim 1, wherein said louvres are disposed at an angle of between 70 and 90 degrees relative to the tube longitudinal axis.

5. A fin according to claim 1, wherein said louvres are disposed at an angle of 80 degrees relative to the tube longitudinal axis.

6. A fin according to claim 1, wherein said fin is manufactured from a thin plate of thermally conductive material.

7. A fin according to claim 1, further including a collar surrounding each of said apertures, said collar defining a generally raised wall projecting perpendicularly from the plane of said base and adapted to contact said tube when said tube is inserted through said aperture to provide a bond of said tube to said fin.

8. A fin according to claim 7, wherein said collar is formed by lancing.

9. A heat exchanger for exchanging heat between the ambient and a heat exchanging fluid that may be in a liquid or vapor phase, comprising:

a fluid tank;

a fluid inlet and a fluid outlet in fluid communication with said tank;

a pair of endsheets disposed at outboard ends of said fluid tank;

a plurality of generally oblong-shaped heat exchanging tubes in fluid communication with said tank disposed between said pair of endsheets, each of said tubes having a longitudinal axis parallel to the flow of fluid therethrough, a major axis and a minor axis and defining a fluid flow path;

a plurality of fin plates extending between said endsheets, each one of said plurality of plates comprising:

a generally planar base having a base longitudinal axis extending between the pair of endsheets, the base longitudinal axis being generally perpendicular to the tube longitudinal axis and a transverse axis generally, said base longitudinal and transverse axes defining a main plane, and wherein substantially the entire main plane of said base is disposed at an obtuse angle relative to the tube longitudinal axis;

a plurality of apertures for receiving the tubes therethrough; and a plurality of louvres disposed on said base and extending generally parallel to the longitudinal axis of said base.

10. A heat exchanger according to claim 9, wherein said main plane of said base extends along the entire length of said tube major axis and is disposed at an angle of between 95 and 130 degrees relative to the tube longitudinal axis.

11. A heat exchanger according to claim 9, wherein each of said plurality of tubes comprises a generally flat tube having an aspect ratio of greater than 4:1, wherein aspect ratio is defined as the ratio of the tube major axis to the tube minor axis.

12. A heat exchanger according to claim 9, wherein said louvres are disposed at an angle of between 75 and 90 degrees relative to the tube longitudinal axis.

13. A heat exchanger according to claim 9, wherein said louvres are disposed at an angle of 80 degrees relative to the tube longitudinal axis.

14. A radiator for use in exchanging heat between the ambient and a coolant in an automotive vehicle, comprising:

a pair of fluid tanks;

a pair of endsheets;

a fluid inlet and a fluid outlet in fluid communication with said tanks;

a plurality of generally flat tubes in fluid communication with each of said tanks disposed between the pair of endsheets, each of said tubes having a longitudinal axis parallel to the flow of fluid therethrough defining a fluid flow path;

a plurality of fin plates extending between the pair of endsheets, each one of said plurality of plates comprising:

a generally planar base having a base longitudinal axis extending between the pair of endsheets, the base longitudinal axis being generally perpendicular to the tube longitudinal axis and a transverse axis generally perpendicular to the base longitudinal axis but being canted at an angle of 100 degrees relative to the tube longitudinal axis, said axes defining a main plane, the main plane of said base extending along the entire major axis of said tubes and which is disposed at an angle of 100 degrees relative to the tube longitudinal axis;

a plurality of apertures for receiving the tubes therethrough, each of said apertures being surrounded by a raised collar adapted to contact said tube after said tube is inserted through said aperture; and a plurality of louvres disposed on said base and extending generally parallel to the longitudinal axis of said base, said louvres being disposed at an angle of 80 degrees to the tube longitudinal axis.

* * * * *